United States Patent [19]

Kuehl

[11] Patent Number: 4,952,083

[45] Date of Patent: Aug. 28, 1990

[54] CONTROLLABLE PITCH PROPELLER ASSEMBLY

[76] Inventor: Fred H. Kuehl, 2065 Lost Dauphin Rd., De Pere, Wis. 54115

[21] Appl. No.: 418,528

[22] Filed: Oct. 10, 1989

[51] Int. Cl.[5] ..... F01B 25/02

[52] U.S. Cl. ..... 416/157 R; 416/162; 416/156

[58] Field of Search ..... 416/93 A, 93 M, 61, 416/49, 167, 157 R, 162, 156

[56] References Cited

U.S. PATENT DOCUMENTS

| | | | |
|---|---|---|---|
| 3,051,249 | 8/1962 | Dirlik | 416/157 R X |
| 3,056,457 | 10/1962 | MacFarland | 416/162 |
| 3,092,186 | 6/1963 | MacLean | 416/157 R X |
| 3,216,507 | 11/1965 | Curioni | 416/157 R |
| 3,232,350 | 2/1966 | Lorenz | 416/162 X |
| 3,338,313 | 8/1967 | Tolley et al. | 416/162 X |
| 3,600,102 | 8/1971 | Dirlik | 416/158 X |
| 4,362,467 | 12/1982 | Elliott | 416/162 X |
| 4,599,043 | 7/1986 | Müller | 416/93 A X |
| 4,704,862 | 11/1987 | Dennison et al. | 416/162 X |
| 4,744,727 | 5/1988 | Müller | 416/167 X |

FOREIGN PATENT DOCUMENTS

| | | | |
|---|---|---|---|
| 126300 | 11/1945 | Australia | 416/166 |
| 168030 | 12/1954 | Australia | 416/162 |

OTHER PUBLICATIONS

EP0154954, Sep. 1985. Muller.

*Primary Examiner*—Edward K. Look
*Assistant Examiner*—Thomas Denion
*Attorney, Agent, or Firm*—Fuller, Ryan & Hohenfeldt

[57] ABSTRACT

A controllable and variable pitch propeller assembly. This assembly includes a main drive shaft mounted for rotation, and a propeller hub connected to the drive shaft for rotation with the drive shaft. Power cylinders are formed integrally in a unitary cylinder member affixed to a watercraft, or to the drive housing thereof. These power cylinders have actuator rods movable with respect to the watercraft in a direction substantially parallel to the drive shaft. A plurality of propeller blades are mounted to the hub for rotation therewith. Each blade is rotatable about a respective hub radial, and each of the blades has at its inner end a respective thrust collar. A ring assembly is provided, connected between the actuator means and the respective thrust collars at one side of each of the propeller blades, the ring assembly causes the propeller blades to rotate about their respective hub radials, thereby changing the pitch of the propeller blades. The power cylinders are spaced apart evenly about the circumference of the hub. The ring assembly surrounds the drive shaft and is connected to the actuator rod, so as to be axially slidable by the actuator rod along the drive shaft. The ring assembly includes a plurality of links, one for each of the propeller blades, each connected at one end to the ring assembly itself and at the other end to the respective thrust collar at one side of the respective propeller blade.

3 Claims, 2 Drawing Sheets

CONTROLLABLE PITCH PROPELLER ASSEMBLY

BACKGROUND OF THE INVENTION

This invention relates to a propeller assembly for use generally in watercraft, and in particular to such a propeller assembly the pitch of the blades of which is variable and controllable by use of stationary power cylinders connected to the rotating blades.

In general, of course, variable pitch propeller assemblies for watercraft are quite well known in the art. The majority of them, however, have been lever-driven. For example, Müller, U.S. Pat. No. 4,599,043, shows a device for changing the pitch of a propeller in a watercraft, in which the change is accomplished by use of a lever at the outflow side of the propeller, which lever is remotely controlled by a hydraulic cylinder. That patent states that the lever may be moved to the inflow side, without explaining how such a transformation is possible. In another example, Muller, U.S. Pat. No. 4,744,727, such a lever is shown positioned at the inflow side of the propeller. However, external levers such as the ones shown in the Müller and Muller patents have the disadvantage of disrupting the water flow around the propeller, providing means for catching weeds, and so on. On the other hand, MacFarland, U.S. Pat. No. 3,056,457, shows a variable pitch propeller wherein the change in pitch is powered by internal hydraulic cylinders and springs. This structure is somewhat complex, however, and it appears that it would be quite expensive to manufacture.

This invention relates to improvements to the apparatus described above and to solutions to the problems raised thereby.

SUMMARY OF THE INVENTION

This invention includes a controllable and variable pitch propeller assembly, generally for driving a watercraft. This assembly includes a main drive shaft mounted for rotation with respect to a drive housing on the watercraft, and a propeller hub connected to the drive shaft for rotation with the shaft. Power cylinder means are provided in a unitary cylinder member affixed to the drive housing, that is, stationary. These power cylinder means have actuator means movable with respect to the drive housing in a direction substantially parallel to the drive shaft. A plurality of propeller blades are mounted to the hub, and project radially outward therefrom. Each blade is rotatable about a respective hub radial, and each of the blades has at its inner end a respective thrust collar. Motion transfer means are provided, connected between the actuator means and the respective thrust collars at one side of each of the propeller blades, such that as the power cylinder means moves the actuator means, the motion transfer means causes the propeller blades to rotate about their respective hub radials, thereby changing the pitch of the propeller blades. The power cylinder means may include a plurality of power cylinders spaced apart evenly about the circumference of the hub, each having an actuator rod movable substantially parallel to the drive shaft. The motion transfer means may include a ring assembly surrounding the drive shaft and connected to the actuator rod, so as to be axially slidable thereby along the drive shaft, and a plurality of link means, one for each of the propeller blades, each connected at one end to the ring assembly and at the other end to the respective thrust collar at one side of the propeller blade. The hub is provided with open spaces to create through-the-hub exhaust ducts.

Other objects and advantages of the invention will become apparent hereinafter.

DESCRIPTION OF THE PREFERRED EMBODIMENT

Figure 3:
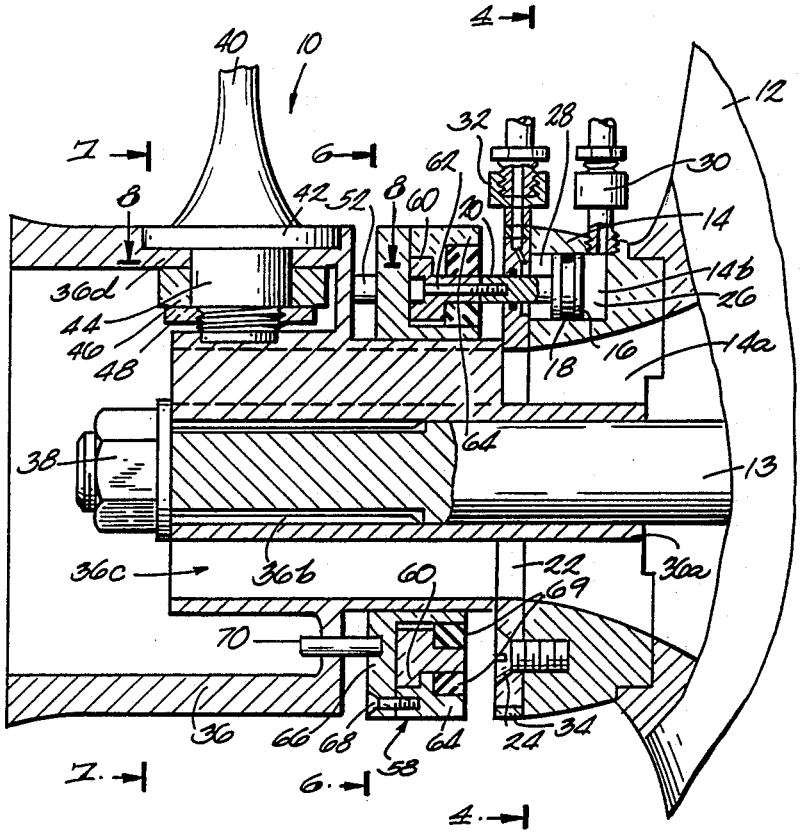
FIG. 3 is a cross sectional view of the assembly shown in FIG. 2, taken along line 3—3.
Figure 1:
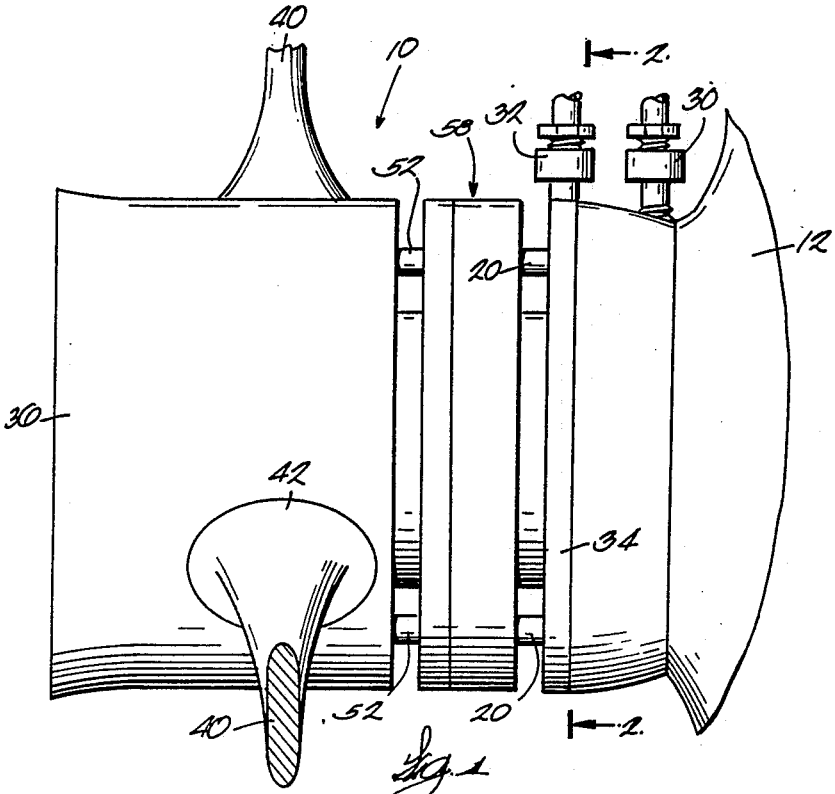
FIG. 1 is a side elevation view of a propeller assembly constructed according to one embodiment of the invention.
Figure 4:
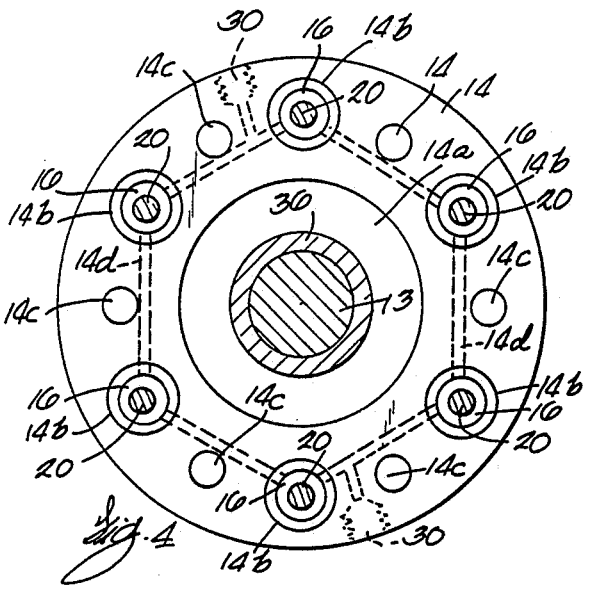
FIG. 4 is a cross sectional view of the assembly shown in FIG. 3, taken along line 4—4.

Referring now to FIG. 1, there is shown a controllable pitch propeller assembly 10 constructed according to the invention and connected to a drive housing 12, such as would be used in connection with a watercraft (not shown). The drive housing 12 is generally stationary with respect to the watercraft, and has a generally conventional drive shaft 13 projecting outward therefrom and driven or rotated by a prime mover, not shown. In the preferred embodiment, as shown in FIGS. 1 and 3, the assembly 10 includes a unitary cylinder member 14 which is affixed to the housing 12, that is, stationary with respect to the watercraft. As can be seen by comparing FIG. 3 and FIG. 4, cylinder member 14 is annular in shape, having an open area **14*a* in the middle thereof. The axis of the cylinder member is substantially co-axial with that of the drive shaft 13. Within the cylinder member 14, there are formed a plurality of cylindrical apertures 14*b*, the axes of which are aligned parallel to the axis of the cylinder member itself These apertures 14*b* are open ended, in the direction facing away from the drive housing 12. As indicated in FIG. 4, in the most preferred embodiment the cylinder member 14 is provided with six of these apertures 14*b***, spaced evenly about the cylinder member.

Into each cylindrical aperture **14*b* is installed a piston 16, again generally cylindrical in shape and coaxial with the aperture. The piston 16 is sized to match the aperture, and is provided with a seal 18 about its outside edge, where it meets the aperture 14*b*. The piston 16 includes a piston rod 20, connected to the side of the piston facing away from the drive housing 12**.

A cylinder cap 22 is applied over the cylinder member 14, and held there by any suitable removable means, such as screws 24 (FIG. 3) inserted through holes **22*a* provided for that purpose in the cylinder cap and threaded into tapped holes 14*c* provided for that purpose in the cylinder member itself. The cylinder cap 22 is also provided with a number of holes 22*b*, spaced around the periphery thereof and aligned with the cylinder apertures 14b of the cylinder member, to permit the free passage of the piston rods 20 therethrough. When thus applied, cylinder cap 22 captures each respective piston 16 within the respective cylinder aperture 14b, but permits it free movement within the confines of that aperture, with each piston rod 20 projecting through the cap at one of the holes 22b**.

Figure 2:
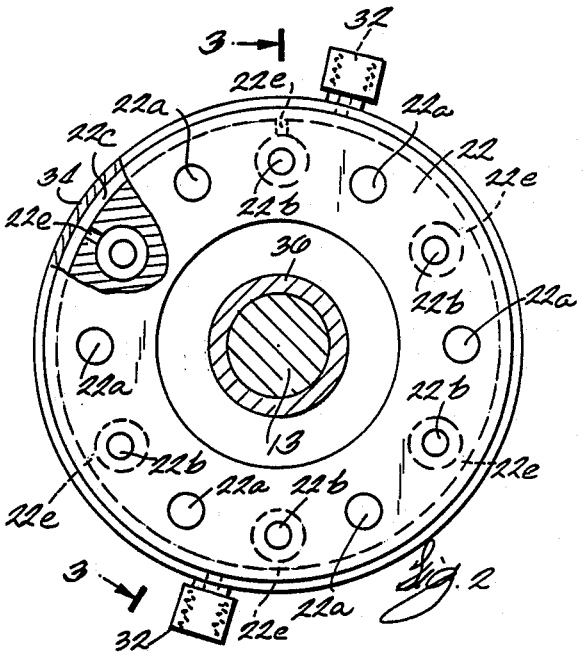
FIG. 2 is a cross sectional view of the assembly shown in FIG. 1, taken along line 2—2.
Figure 5:
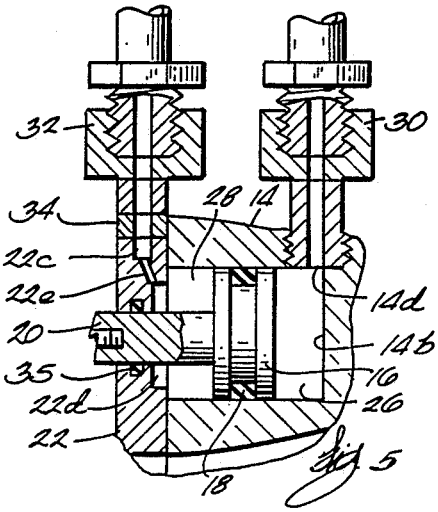
FIG. 5 is a view of a portion of the hydraulic system shown in FIG. 3 for controlling the pitch of the propeller, on an enlarged scale.

There are thus formed two separate chambers 26 and 28, one on each side of the piston 16, within the cylinder aperture 14b. Chamber 26 is on the side of the piston 16 nearest the drive housing, while chamber 28 is on the side of the piston 16 furthest from the drive housing. To each of those chambers 26 and 28 is connected a source of fluid energy, such as hydraulic fluid. As shown on an enlarged scale in FIG. 5, the chambers 26 are connected to a hydraulic fluid source, under the control of the operator of the assembly 10, by one or more hydraulic connections 30, via interconnecting passages 14d (FIG. 4). Correspondingly, comparing FIGS. 2 and 5 it can be seen that chamber 28 is connected to a second hydraulic fluid source via an annular channel 22c formed in the outside edge of the cylinder cap 22. The assembly 10 is provided with one or more hydraulic connectors 32, which are connected between the second source of pressurized hydraulic fluid, also under the control of the operator of the assembly 10, and annular channel 22c.

A cover ring 34 is provided, and suitably attached over the outside edge of the cylinder cap 22, for closing the channel 22c so as to facilitate the manufacture and assembly of the cylinder cap. A number of cavities 22d are formed in the cylinder cap 22, one corresponding to each of the cylindrical apertures 14b formed in the cylinder member 14. As can be seen by comparing FIGS. 2 and 5, each cavity 22d is connected to the channel 22c by a separate bore 22e formed in the cylinder cap 22, which bore leads between the cavity and the channel. Seals 18 and 35, about the piston 16, and piston rod 20, respectively, maintain proper hydraulic pressure and reduce leakage of hydraulic fluid. There is thus provided a two-way hydraulic cylinder which, by use of the piston rod 20 is capable of exerting force in both directions, both toward and away from the drive housing 12.

To the drive shaft 13 is attached a propeller hub 36. This propeller hub 36 would normally include a long, cylindrical opening 36a sized to fit snugly onto the drive shaft 13. Means 36b to prevent relative rotation between the drive shaft 13 and the hub 36 are provided. In the embodiment shown in FIG. 3, the drive shaft 13 and the hub 36 are connected together by splining, although any other suitable means, such as keying, could also be employed. The hub 36 is retained on the drive shaft 13 by a nut 38 threaded onto the end of the drive shaft. Hence the propeller hub 36 rotates with the drive shaft 13. As can be seen by comparing FIGS. 6 and 7 with FIG. 3, the hub 36 has large openings 36c which run the length of the hub. By means of these openings 36c, hub 36 is open to the passage of exhaust gases therethrough.

Figure 7:
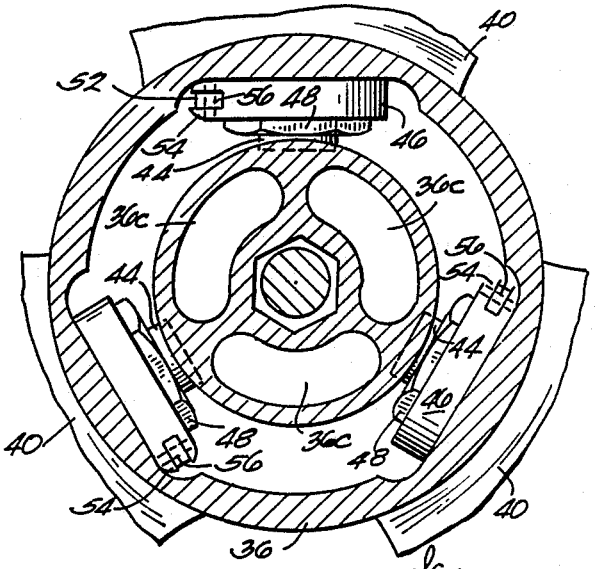
FIG. 7 is a cross sectional view of the assembly shown in FIG. 3, taken along line 7—7.

As shown in FIGS. 1, 3 and 7, the hub 36 has a plurality of propeller blades 40 connected thereto, and projecting radially outward therefrom. It is an object of the invention to provide some means for synchronously rotating each of these propeller blades 40 about its respective radial, thus in effect to change the pitch of the blades, remotely without requiring that the drive shaft 13 be stopped or interrupted in any way. To this end, the connection of each of the propeller blades 40 to the hub 36 is a rotatable connection Each blade 40 is provided with a rounded base 42, which is fitted into a corresponding opening in the hub 36. Each blade 40 has a short shaft 44 which projects radially into the hub 36. The shaft 44, and hence the blade 40, is retained in the hub 36 by any suitable retaining means. In the embodiment shown in FIGS. 3, 7 and 8, the blade 40 is retained in the hub 36 by a thrust collar 46, slidably applied over the shaft 44, and a nut 48 threaded onto the end of the shaft which projects into the hub. A flange 36d of the hub 36 and the thrust collar 46 are thus captured between the nut 48 and the base 42. The thrust collar 46 is prevented from rotating with respect to the shaft 44 by any suitable means, such as a key 50, inserted as shown in FIG. 8 in corresponding slots in the shaft and the collar.

Figure 8:
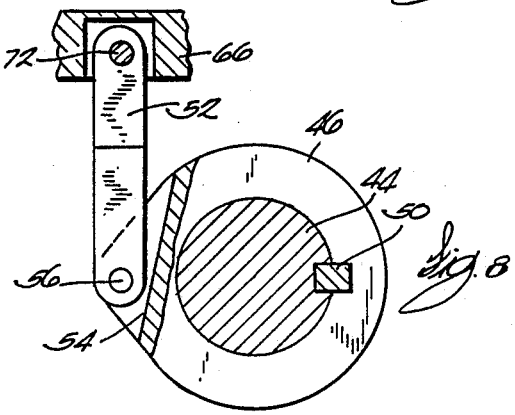
FIG. 8 is a cross sectional view of the assembly shown in FIG. 3, taken along line 8—8.

As can be seen by comparing FIGS. 7 and 8, the thrust collar 46 is suitably connected to a link 52 in such a way that linear movement, such as axial movement, of the link, results in rotating movement of the thrust collar 46 and corresponding rotating movement of the blade 40. In the embodiment shown in FIGS. 7 and 8, the thrust collar 46 includes a clevis portion 54 which straddles the link 52. A pin 56 passes through the clevis 54 and the link 52 to connect the two together.

Up to this point, there have been described pistons 16 and piston rods 20 for providing power for linear motion, and thrust collars 46 and links 52 for converting linear motion to the rotary motion required to actually change the pitch of the blades. However, the piston rods 20 cannot be connected directly to the links 52, because the links are rotating with the blades 40, propeller hub 36 and drive shaft 13, while the piston rods are connected to the stationary cylinder member 14 and drive housing 12. Therefore, means must be provided to transfer this linear motion of the piston rods 20 to the links 52, even though the piston rods are not rotating and the links are.

Figure 6:
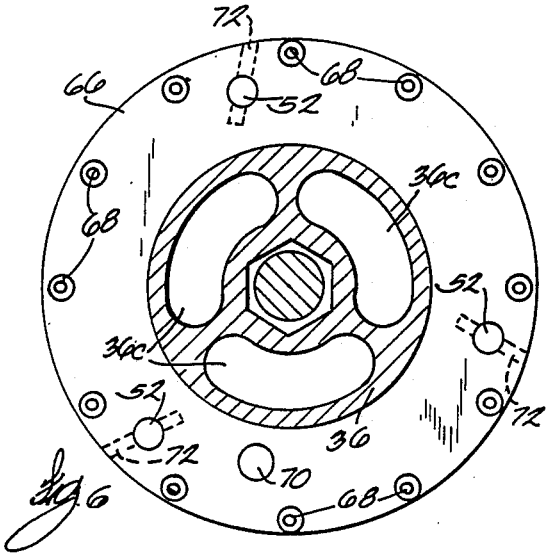
FIG. 6 is a cross sectional view of the assembly shown in FIG. 3, taken along line 6—6.

According to the present invention, a journaled ring arrangement 58 is provided to accomplish this transfer. As shown in FIG. 3, this arrangement 58 includes a non-rotating ring 60 secured, such as by screws 62, to the plurality of piston rods 20. As indicated in FIG. 3, this ring 60 is generally T-shaped in cross-section. Ring 60 is somewhat loosely retained between two rotating rings 64 and 66, which are connected together, such as by screws 68 (FIGS. 3 and 6). Lubrication may be provided between ring 60 and the rotating rings 64 and 66, and seals 69 to retain that lubrication in place and reduce wear as much as possible.

The rotating rings 64 and 66 are generally mounted to the hub 36 by any suitable means permitting them to slide freely, axially fore and aft, along the hub, while preventing relative rotation between the rings and the hub. In the most preferred embodiment, a pin 70 is provided generally parallel to the drive shaft 13, and either affixed to the ring 66 and slidably inserted into a hole in the hub 36, or affixed to the hub and slidably inserted into a hole in the ring. Rotating ring 66, then, being the rotating ring nearer the blades 40, is connected to the links 52, as shown in FIG. 8, by means of a pin 72.

In operation, then, the propeller hub 36, when in use, will be rotating at high speed, with the propeller blades 40 operating a some particular pitch. If the operator wishes to change the pitch of the blades 40, he causes hydraulic fluid to flow into either chamber 26 or chamber 28, depending upon whether he wishes to increase or decrease the pitch. Depending upon which chamber is selected, the piston 16, and correspondingly the piston rod 20 is caused to move linearly to enlarge the chamber. This movement in turn causes journaled ring arrangement 58 to move linearly in the same direction, forcing links 52 to follow suit. The linear movement of links 52 causes the rotational movement of the blades 40, thereby resulting in control and variation of the pitch of the blades.

While the apparatus hereinbefore described is effectively adapted to fulfill the aforesaid objects, it is to be understood that the invention is not intended to be limited to the specific preferred embodiment of controllable pitch propeller assembly set forth above. Rather, it is to be taken as including all reasonable equivalents within the scope of the following claims.

I claim:

1. A controllable pitch propeller assembly comprising:

a main drive shaft rotatable with respect to a stationary mounting;

a propeller hub connected to said shaft for rotation therewith;

a number of propeller blades, each projecting radially outward from said hub and mounted to be rotatable about a respective radial, each of said blades having at its inner end a respective thrust collar;

power cylinder means formed in a unitary cylinder member and mounted to said mounting, said power cylinder means comprising a number of power cylinders integrally formed within said cylinder member and spaced apart evenly about said cylinder member, each having an actuator rod movable with respect to said mounting in a direction substantially parallel to said drive shaft;

said number of power cylinders being greater than said number of propeller blades;

a journaled ring assembly surrounding said drive shaft and connected to each of said actuator rods so as to be axially slidable by said power cylinders along said drive shaft, said ring assembly comprising a non-rotating ring affixed to said actuator rods and a pair of rotating rings slidably capturing said non-rotating ring in such a manner that said rotating rings are rotatable with respect to said non-rotating ring;

a plurality of link means, one for each of said propeller blades, each connected at one end to one of said rotating rings and at the other end to said respective thrust collar.

2. A controllable pitch propeller assembly as recited in claim 1 wherein each of said power cylinders is a double-acting power cylinder, and wherein said non-rotating ring has such a cross-sectional shape as to permit said non-rotating ring to exert pulling as well as pushing forces on said rotating rings.

3. A controllable pitch propeller assembly as recited in claim 2 wherein said non-rotating ring has a T-shaped cross-sectional shape as to permit said non-rotating ring to exert pulling as well as pushing forces on said rotating rings.

* * * * *